US008224196B2

(12) United States Patent
Oh

(10) Patent No.: US 8,224,196 B2
(45) Date of Patent: Jul. 17, 2012

(54) WASTE TONER DETECTING DEVICE, IMAGE FORMING APPARATUS HAVING THE SAME, AND METHOD THEREOF

(75) Inventor: Jin Kyu Oh, Anyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1039 days.

(21) Appl. No.: 11/935,047

(22) Filed: Nov. 5, 2007

(65) Prior Publication Data

US 2008/0181633 A1 Jul. 31, 2008

(30) Foreign Application Priority Data

Jan. 26, 2007 (KR) ..... 10-2007-0008466

(51) Int. Cl.
*G03G 21/12* (2006.01)

(52) U.S. Cl. ..... 399/35; 399/120; 399/358; 399/359; 399/360; 430/119.87; 430/119.88

(58) Field of Classification Search ..... 399/35, 399/13, 34, 99, 120, 358–360, 119.87–119.88; 430/119.87–119.88
See application file for complete search history.

(56) References Cited

U.S. PATENT DOCUMENTS 3,760,184 A * 9/1973 Brose ..... 250/559.43
4,028,553 A * 6/1977 Farcinade ..... 250/576
4,064,754 A * 12/1977 Frey ..... 73/313
4,099,861 A * 7/1978 Abel ..... 399/34
4,119,860 A * 10/1978 Gooley ..... 250/577
4,761,674 A * 8/1988 Ogura ..... 399/35
5,398,106 A * 3/1995 Eguchi ..... 399/110
(Continued)

FOREIGN PATENT DOCUMENTS

KR 2006-37955 5/2006

OTHER PUBLICATIONS

Chinese Office Action issued Apr. 17, 2009 in CN Application No. 200710169374.6.

*Primary Examiner* — David Gray
*Assistant Examiner* — Geoffrey Evans
(74) *Attorney, Agent, or Firm* — Stanzione & Kim, LLP

(57) ABSTRACT

An image forming apparatus to check an amount of waste toner stored in a waste toner container in stages. The image forming apparatus includes a main body, a waste toner container which is installed in the main body to store waste toner, a light emitting part which emits light to detect an amount of the waste toner stored in the waste toner container, a plurality of light receiving parts which receive the light emitted from the light emitting part, and a light distribution member which distributes the light emitted from the light emitting part to the plurality of light receiving parts. Waste toner detecting regions are respectively defined on light paths between the light distribution member and the plurality of light receiving parts. The waste toner detecting regions are located at different positions along an accumulated direction of the waste toner in the waste toner container. Also, the image forming apparatus has a light path member which extends from the light distribution member such that a first end is connected to the light distribution member and a second end opposes one of the plurality of light receiving parts, thereby additionally determining whether the waste toner container is installed.

23 Claims, 10 Drawing Sheets

U.S. PATENT DOCUMENTS

| | | | | |
|---|---|---|---|---|
| 5,499,077 | A | 3/1996 | Endo et al. | |
| 5,589,915 | A * | 12/1996 | Hashimoto | 399/120 |
| 5,825,478 | A * | 10/1998 | Wilcox et al. | 356/73 |
| 5,890,049 | A * | 3/1999 | Williams et al. | 399/360 |
| 5,899,597 | A * | 5/1999 | Shinohara et al. | 399/64 |
| 5,899,605 | A * | 5/1999 | Caruthers et al. | 399/223 |
| 6,055,406 | A * | 4/2000 | Kawai et al. | 399/360 |
| 6,081,676 | A * | 6/2000 | Inomata | 399/25 |
| 6,181,886 | B1 * | 1/2001 | Hockey et al. | 399/35 |
| 6,925,871 | B2 * | 8/2005 | Frank | 73/293 |
| 7,356,269 | B2 * | 4/2008 | Park | 399/35 |
| 7,805,088 | B2 * | 9/2010 | Bae | 399/27 |
| 7,872,746 | B2 * | 1/2011 | Gao et al. | 356/246 |
| 8,000,617 | B2 * | 8/2011 | Kim et al. | 399/27 |
| 8,032,038 | B2 * | 10/2011 | Ushikubo | 399/27 |
| 2004/0086291 | A1 * | 5/2004 | Sasaki et al. | 399/57 |
| 2004/0109039 | A1 * | 6/2004 | Kojima et al. | 347/19 |
| 2004/0190918 | A1 * | 9/2004 | Park | 399/35 |
| 2007/0196117 | A1 * | 8/2007 | Ishii | 399/35 |
| 2008/0181627 | A1 * | 7/2008 | Bae | 399/27 |
| 2008/0286005 | A1 * | 11/2008 | Ushikubo | 399/119 |
| 2010/0104299 | A1 * | 4/2010 | Oh | 399/35 |
| 2010/0166441 | A1 * | 7/2010 | Kobayashi | 399/35 |

* cited by examiner

WASTE TONER DETECTING DEVICE, IMAGE FORMING APPARATUS HAVING THE SAME, AND METHOD THEREOF

CROSS-REFERENCE TO RELATED APPLICATIONS

This application claims priority under 35 U.S.C. §119(a) from Korean Patent Application No. 2007-0008466, filed on Jan. 26, 2007 in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly to an image forming apparatus which is equipped with a waste toner container to store waste toner generated during a printing process, and a method thereof.

2. Description of the Related Art

A conventional image forming apparatus is an apparatus that prints an image onto a printing medium, e.g., a paper, according to an input image signal. As one type of the image forming apparatus, an electro photographic image forming apparatus is configured such that a light beam is scanned to a photosensitive member charged with electric potential to form an electrostatic latent image thereon, the electrostatic latent image is developed to a toner image by using toner, and the toner image is transferred and fixed to a paper.

The toner image developed on the photosensitive member is transferred to the paper directly or via an intermediate transfer device. When the toner image is transferred to the paper or the intermediate transfer device from the photosensitive member, or when the toner image is transferred to the paper from the intermediate transfer device, the toner image is not entirely transferred, but a portion of the toner remains on the photosensitive member or the intermediate transfer device. The residual waste toner is collected by a waste toner collecting device, and is stored in a waste toner container.

Korean Patent Laid-open Publication No. 2006-0037955 discloses a device for detecting an amount of waste toner accumulated and stored in a waste toner container. The conventional waste toner detecting device includes a light emitting part and a light receiving part disposed opposite to the light emitting part. When the light receiving part cannot receive the light from the light emitting part, it is determined that the waste toner is stored in the waste toner container above a predetermined amount.

However, the conventional image forming apparatus equipped with the above conventional waste toner detecting device alerts a user to replace the waste toner container just when the waste toner container is full of waste toner. Therefore, unless the user prepares a new waste toner container in advance, the user cannot use the image forming apparatus until preparing a new waste toner container.

Considering the above problem, a plurality of light emitting parts positioned at different heights and a plurality of light receiving parts corresponding to the respective light emitting parts may be provided, so as to inform the user of the amount of the waste toner stored in the waste toner container by stages. However, providing multiple light emitting parts causes an increase in manufacturing costs due to the increased number of both the light emitting parts and the light receiving parts.

Also, the above conventional the waste toner detecting device is configured to detect only whether the waste toner container is full of the waste toner, but cannot independently detect whether the waste toner container is installed in the image forming apparatus. Accordingly, the conventional image forming apparatus should be provided with an additional sensing unit for checking whether the waste toner container is installed.

SUMMARY OF THE INVENTION

The present general inventive concept provides an image forming apparatus which is equipped with an improved waste toner detecting device to check an amount of waste toner accumulated and stored in a waste toner container in multiple stages.

The present general inventive concept also provides an image forming apparatus to check whether the waste toner container is installed by using the waste toner detecting device.

Additional aspects and/or utilities of the present general inventive concept will be set forth in part in the description which follows and, in part, will be obvious from the description, or may be learned by practice of the general inventive concept.

The foregoing and/or other aspects and utilities of the present general inventive concept are achieved by providing an image forming apparatus including a main body, a waste toner container which is installed in the main body to store waste toner, a light emitting part which emits light to detect an amount of the waste toner stored in the waste toner container, a plurality of light receiving parts which receive the light emitted from the light emitting part, and a light distribution member which distributes the light emitted from the light emitting part to the plurality of light receiving parts.

Waste toner detecting regions may be respectively defined on light paths between the light distribution member and the plurality of light receiving parts. The waste toner detecting regions may be located at different positions along an accumulated direction of the waste toner in the waste toner container.

The light distribution member may include a plurality of reflecting portions which reflect the light emitted from the light emitting part in different directions.

The image forming apparatus may further include light guide members which guide the light distributed from the light distribution member to the light receiving parts respectively corresponding to the light guide members.

Each of the light guide members may include a reflecting portion which reflects the light transmitted from the light distribution member to the light receiving parts.

The light emitting part and the light receiving parts may be mounted on the main body, and the light distribution member and the light guide members may be mounted on the waste toner container.

The light distribution member and the light guide members may be made of a transparent material that light can permeate.

At least one of the light distribution member and the light guide members may be formed integrally with the waste toner container.

The image forming apparatus may further include a light path member which extends from the light distribution member, the light path member having a first end connected to the light distribution member and a second end corresponding to one of the plurality of light receiving parts.

The foregoing and/or other aspects and utilities of the present general inventive concept can also be achieved by providing an image forming apparatus including a waste toner detecting device to detect an amount of waste toner stored in a waste toner container, where the waste toner detecting device includes a light emitting part which emits light to an interior portion of the waste toner container, a light distribution member which disperses the light emitted from the light emitting part, and a waste toner detecting portion defined on a path of the light from the light distribution member.

The light distribution member may disperse the light emitted from the light emitting part in at least two directions and the waste toner detecting portion may include a plurality of waste toner detecting regions located at different positions.

The waste toner detecting device may further include a plurality of light receiving parts which receive the light distributed from the light distribution member.

The light distribution member may include a plurality of reflecting portions which reflect the light emitted from the light emitting part in different directions.

The waste toner detecting device may further include at least one light guide member provided on paths of the light progressing in different directions from the light distribution member and guide the light to the light receiving parts respectively corresponding to the light guide members.

The plurality of light receiving parts may include a light receiving part which receives the light regardless of the amount of the waste toner stored in the waste toner container.

The foregoing and/or other aspects and utilities of the present general inventive concept can also be achieved by providing a waste toner detecting device of an image forming apparatus, the waste toner detecting device including a light emitting part to emit light in various directions in an interior portion of a waste toner container, and a plurality of waste toner detecting regions distributed inside the interior portion of the waste toner container to detect the light emitted from the light emitting part and to determine an amount of waste toner accumulated in the waste toner container based on the detected light.

The plurality of waste toner detecting regions may include a plurality of light receiving parts to receive the light emitted from the light emitting part and a plurality of light guide parts to guide the light emitted from the light emitting part to the plurality of light receiving parts.

The waste toner detecting device may further include a plurality of light guide parts to guide the light emitted from the light emitting part to the plurality of light receiving parts.

The waste toner detecting device may further include a light path member to guide the light emitted to one of the plurality of light receiving parts regardless of the amount of accumulated waste toner.

The at least one of the plurality of light receiving parts may detect whether the waste toner container is installed in the image forming apparatus.

The waste toner detecting device may further include a light distribution member to perform the distribution of the light in various directions and to direct the distributed light toward the plurality of waste toner detecting regions.

The plurality of waste toner detecting regions may send a signal to a display on the image forming apparatus to alert a user when the waste toner container has reached various accumulation capacities based on the detection of the light emitted from the light emitting part.

The foregoing and/or other aspects and utilities of the present general inventive concept can also be achieved by providing an image forming apparatus, including a casing, a photosensitive body to form an electrostatic latent image thereupon with toner, an intermediate transfer belt to transfer the toner corresponding to the electrostatic latent image from the photosensitive body to a printing medium, a waste toner container to collect waste toner expelled from the intermediate transfer belt, and a waste toner detecting device, including a light emitting part to emit light in various directions in an interior portion of the waste toner container, and a plurality of waste toner detecting regions distributed inside the interior portion of the waste toner container to detect an amount of accumulated waste toner based on a detection of the light emitted from the light emitting part.

The casing may further include a display to alert a user when the waste toner container has reached various accumulation capacities based on the detection of the light emitted from the light emitting part.

The foregoing and/or other aspects and utilities of the present general inventive concept can also be achieved by providing a method of detecting an accumulation of a waste toner in a waste toner container detachably installed in an image forming apparatus, the method including emitting light from a light emitting part inside the waste toner container in a plurality of directions, receiving the light emitted from the light emitting part using a plurality of light receiving parts, detecting an amount of the waste toner accumulated in the waste toner container based on which of the plurality of light receiving parts receives the light, and alerting a user of various waste toner accumulation levels based on the detected amount of waste toner.

The method may further include detecting whether the wasted toner container is attached to the image forming apparatus based on whether one of the plurality of light receiving parts receives the light.

The one of the plurality of light receiving parts may always receive the light when the wasted toner container is attached to the image forming apparatus.

BRIEF DESCRIPTION OF THE DRAWINGS

These and/or other aspects and utilities of the present general inventive concept will become apparent and more readily appreciated from the following description of the embodiments, taken in conjunction with the accompanying drawings, of which.

DETAILED DESCRIPTION OF THE PREFERRED EMBODIMENTS

Figure 1:
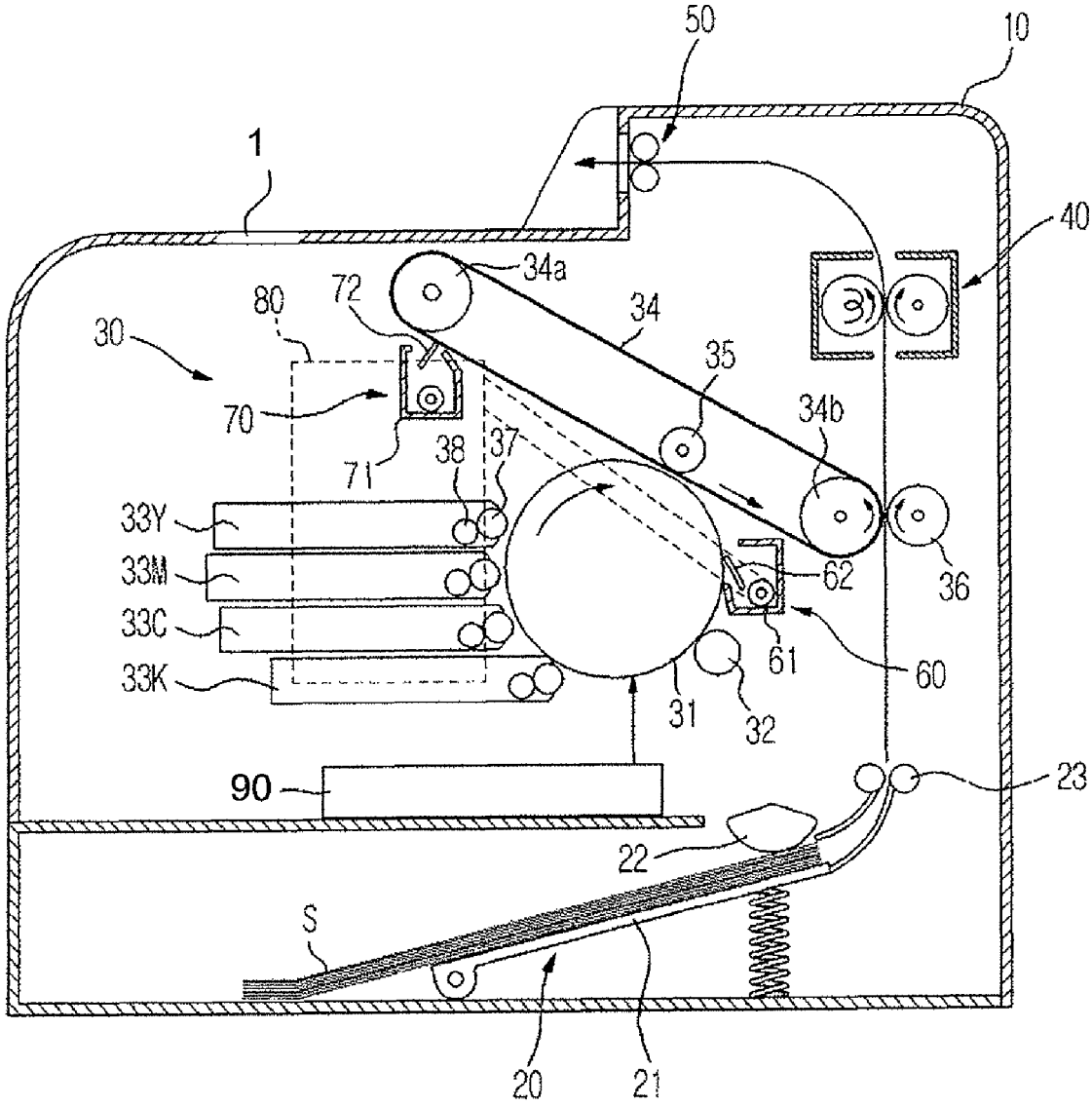
FIG. 1 is a sectional view illustrating an image forming apparatus according to an embodiment of the present general inventive concept.

Reference will now be made in detail to the embodiments of the present general inventive concept, examples of which are illustrated in the accompanying drawings, wherein like reference numerals refer to like elements throughout. The embodiments are described below to explain the present general inventive concept by referring to the figures.

FIG. 1 is a sectional view illustrating an image forming apparatus according to an embodiment of the present general inventive concept.

As illustrated in FIG. 1, the image forming apparatus according to an embodiment of the present general inventive concept includes a main body 10 which forms an exterior appearance and supports components accommodated therein, a paper feeding unit 20 to supply a printing medium, i.e., paper S, a developing unit 30 to develop images on the paper S, a fixing unit 40 to fix the images on the paper S by applying heat and pressure to the paper S, and a discharge unit 50 to discharge the printed paper S to the exterior of the main body 10. The main body 10 may also include a display 1 to provide information to a user pertaining to printing status, printing error, and alerts. The display 1 may be any type of digital, analog, LCD, plasma, or other type of display which can emit information regarding the above information.

The paper feeding unit 20 includes a paper tray 21 on which the paper S is loaded, a pickup roller 22 which picks up the paper S loaded on the paper tray 21 sheet by sheet, and a feed roller 23 which feeds the picked-up paper S toward the developing unit 30.

The developing unit 30 includes a photosensitive body 31 on which an electrostatic latent image is formed by an exposure unit 90, a charge roller 32 to charge the photosensitive body 31, four developing devices 33Y, 33M, 33C and 33K which develop the electrostatic latent image formed on the photosensitive body 31 to a toner image by using yellow, magenta, cyan and black toner, respectively, an intermediate transfer belt 34, a first transfer roller 35, and a second transfer roller 36.

Each of the developing devices 33Y, 33M, 33C and 33K includes a developing roller 37 which develops the electrostatic latent image formed on the photosensitive body 31 to a visible image, and a supply roller 38 which rotates while contacting the developing roller 37 to supply the toner to the developing roller 37.

The intermediate transfer belt 34 is supported by support rollers 34*a* and 34*b*, so as to run at a same linear velocity as a rotational velocity of the photosensitive body 31. The first transfer roller 35 is disposed opposite to the photosensitive body 31, and transfers the toner image developed on the photosensitive body 31 to the intermediate transfer belt 34. The second transfer roller 36 is disposed opposite to the support roller 34*b*. While the toner image is transferred to the intermediate transfer belt 34 from the photosensitive body 31, the second transfer roller 36 is spaced apart from the intermediate transfer belt 34 to not contact the intermediate transfer belt 34. When the toner image is completely transferred to the intermediate transfer belt 34, the second transfer roller 36 comes into contact with the intermediate transfer belt 34 with a specific pressure. When the second transfer roller 36 contacts the intermediate transfer belt 34, the toner image of the intermediate transfer belt 34 is transferred to the paper S.

During the process of transferring the toner image to the photosensitive body 31, the intermediate transfer belt 34, and then the paper S, a portion of the toner remains on the photosensitive body 31 and/or the intermediate transfer belt 34. In order to print the subsequent sheet of paper S, the residual waste toner on the photosensitive body 31 and the intermediate transfer belt 34 must be removed. The image forming apparatus includes a first cleaning unit 60 and a second cleaning unit 70 to remove the residual waste toner.

The first cleaning unit 60 is provided to remove the waste toner from the photosensitive body 31. The first cleaning unit 60 includes a waste toner collecting case 61, a cleaning blade 62 which rakes out the waste toner from the photosensitive body 31, and a transferring device (not illustrated) which transfers the waste toner collected in the waste toner collecting case 61 to a waste toner container 80. The transferring device may be configured as an auger that has a spiral blade and transfers the waste toner by the rotation. The second cleaning unit 70 is provided to remove the waste toner from the intermediate transfer belt 34. Similarly to the first cleaning unit 60, the second cleaning unit 70 includes a waste toner collecting case 71 and a cleaning blade 72. The waste toner collected in the waste toner collecting case 71 of the second cleaning unit 70 is also transferred to the waste toner container 80 by the transferring device. The waste toner transferred from the first cleaning unit 60 and the second cleaning unit 70 drops freely by gravity and is accumulated in the waste toner container 80.

Figure 2:
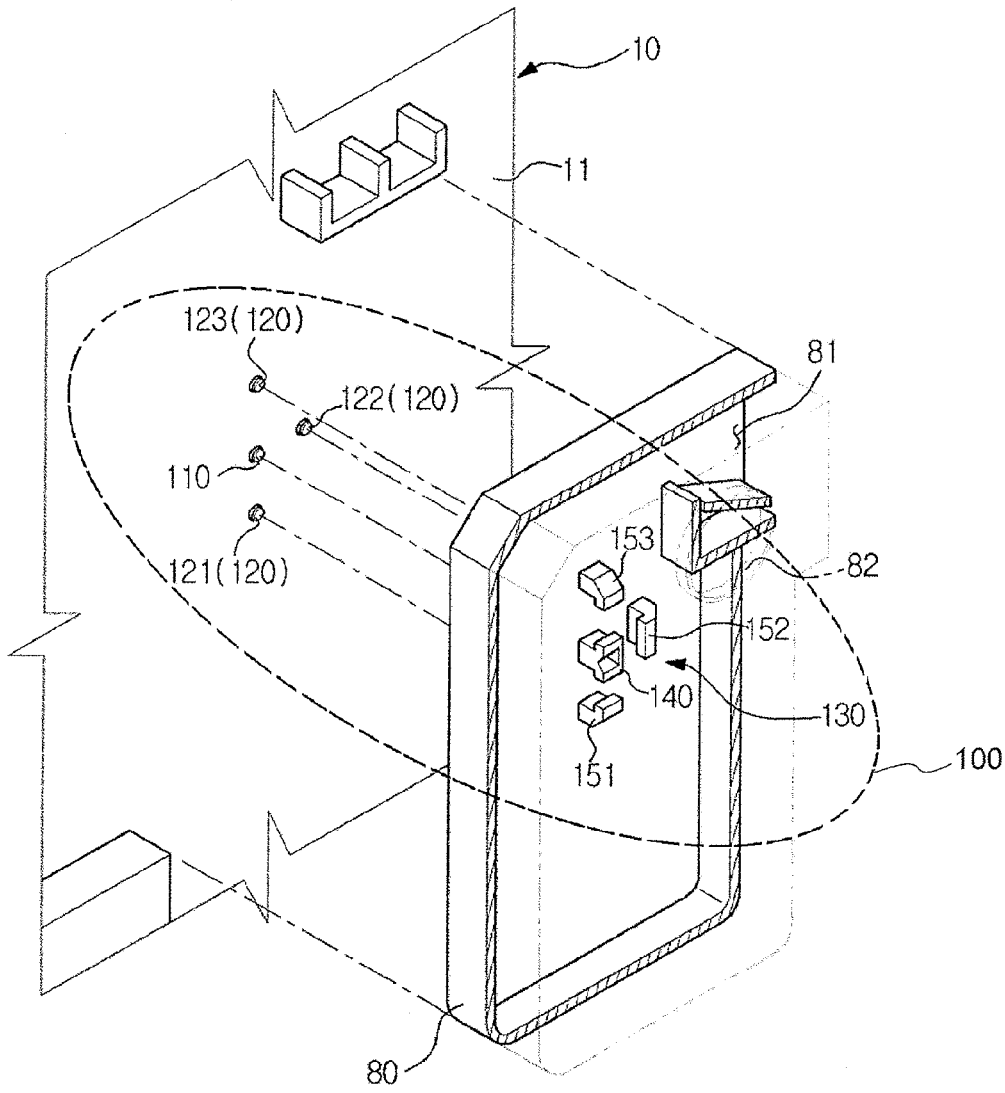
FIG. 2 is a perspective view illustrating a waste toner container and a waste toner detecting device of an image forming apparatus according to an embodiment of the present general inventive concept.
Figure 3:
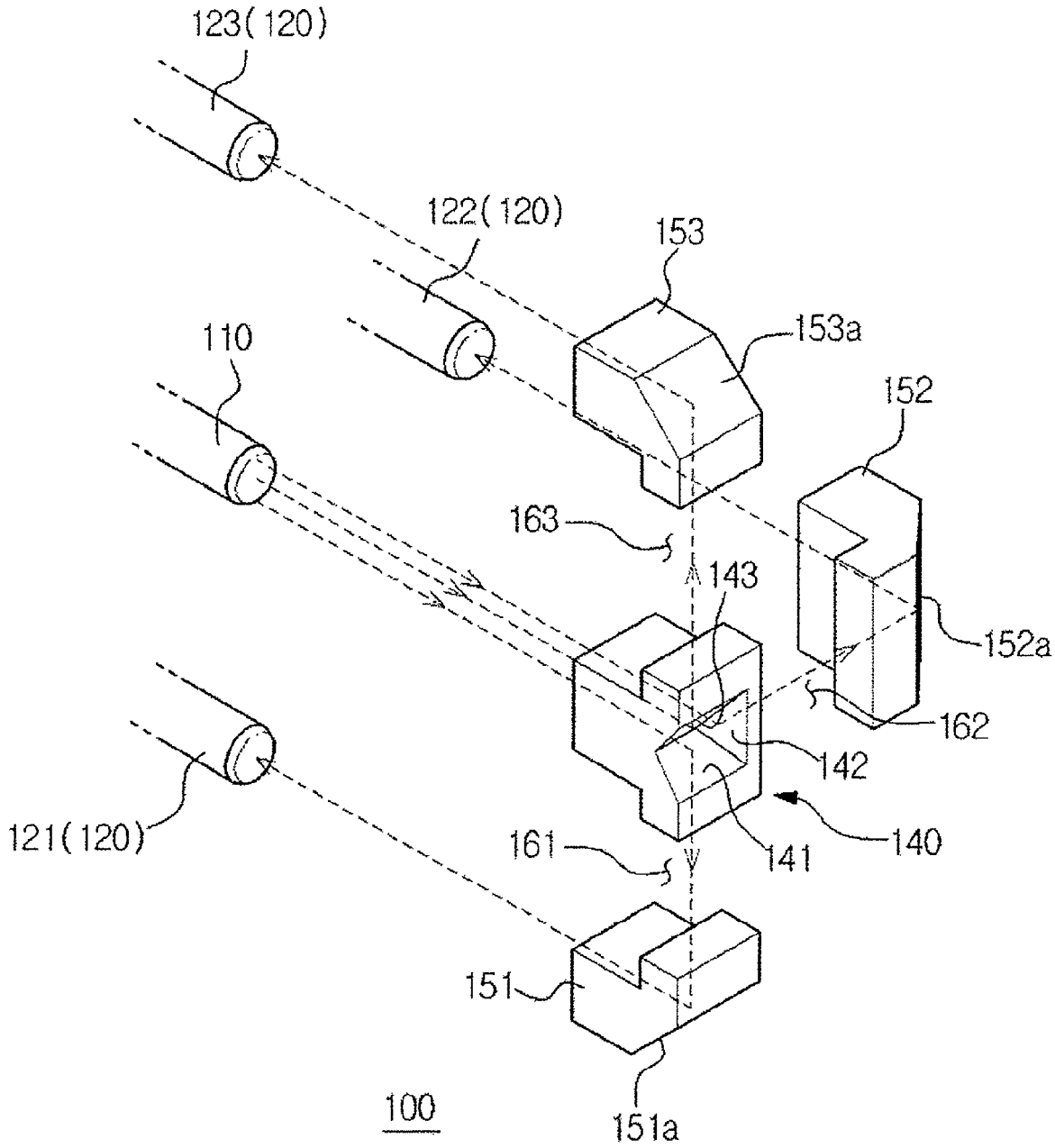
FIG. 3 is an enlarged perspective view illustrating the waste toner detecting device depicted in FIG. 2.

The image forming apparatus of the present general inventive concept further includes a waste toner detecting device 100, as illustrated in FIGS. 2 and 3, to detect an amount of the waste toner stored in the waste toner container 80. The waste toner detecting device informs a user of the amount of the waste toner stored in the waste toner container 80, and accordingly enables the user to replace the waste toner container 80 at a time when the waste toner container reaches a particular accumulation capacity.

FIG. 2 is a perspective view illustrating the waste toner container 80 and the waste toner detecting device 100 of the image forming apparatus according to an embodiment of the present general inventive concept, and FIG. 3 is an enlarged perspective view illustrating the waste toner detecting device depicted in FIG. 2.

As illustrated in FIGS. 2 and 3, the waste toner container 80 is detachably mounted to an inner surface of the main body 10. A first inlet port 81 and a second inlet port 82, through which the waste toner transferred from the first cleaning unit 60 and the second cleaning unit 70 is respectively put into the waste toner container 80, are formed at an upper portion of the waste toner container 80. The waste toner container 80 may be made of a transparent material that light can permeate, e.g., acrylic.

The waste toner detecting device 100 includes a light emitting part 110 and a plurality of light receiving parts 120. In the embodiment of FIGS. 2 and 3, the waste toner detecting device 100 has three light receiving parts 120 (a first light receiving part 121, a second light receiving part 122, and a third light receiving part 123). However, a number of the light receiving parts 120 may be increased or reduced as needed.

The light emitting part 110 and the light receiving parts 120 are mounted to the inner surface 11 of the main body 10 opposite to the waste toner container 80, and are in parallel with each other. The light emitting part 110 emits light into the waste toner container 80, and the light receiving parts 120 receive the light emitted from the light emitting part 110 to detect the amount of the waste toner accumulated and stored in the waste toner container 80.

The waste toner container 80 is provided with a light guide part 130 which guides the light emitted from the light emitting part 110 to the light receiving parts 120. The light guide part 130 includes a light distribution member 140 which distributes the light emitted from the light emitting part 110 to the plurality of light receiving parts 120. The light distribution member 140 is mounted to an inner surface of a side wall of the waste toner container 80 opposite to the side panel of the main body 10. The light distribution member 140 is located at a position corresponding to the light emitting part 110. The light distribution member 140 is made of a transparent material that light can permeate. The light distribution member 140 may be formed integrally with the waste toner container 80.

The light distribution member 140 disperses the light emitted from the light emitting part 110 in several directions so that the amount of waste toner stored in the waste toner container 80 can be detected at several positions. For this, the light distribution member 140 has first, second, and third reflecting portions 141, 142 and 143, respectively, that reflect the light emitted from the light emitting part 110 in different directions. The first reflecting portion 141 is formed to reflect the light from the light emitting part 110 downward. The second reflecting portion 142 is formed to reflect the light from the light emitting part 110 sideways. The third reflecting portion 143 is formed to reflect the light from the light emitting part 110 upward. A number of reflecting portions may be increased or reduced according to a number of light receiving parts.

The light guide part 130 further includes first, second, and third light guide members 151, 152 and 153, respectively, which are disposed on the light paths between the light distribution member 140 and the light receiving parts 120 so as to guide the light dispersed from the light distribution member 140 to the light receiving parts 121, 122 and 123. The first, second, and third light guide member 151, 152, and 153 may each correspond to the first, second and third light receiving parts 121, 122, and 123, respectively. A number of light guide members included in the light guide part 130 may also be increased or reduced as needed to allow each additional light receiving part to have an additional corresponding light guide part. Similarly to the light distribution member 140, the light guide members 151, 152 and 153 are made of a transparent material that light can permeate. The first, second, and third light guide members 151, 152 and 153 may be formed integrally with the waste toner container 80.

The first light guide member 151 guides the light reflected downward from the first reflecting portion 141 to the first light receiving part 121. The second light guide member 152 guides the light reflected sideways from the second reflecting portion 142 to the second light receiving part 122. The third light guide member 153 guides the light reflected upward from the third reflecting portion 143 to the third light receiving part 123. For this, the first, second, and third light guide members 151, 152 and 153 include reflecting portions 151*a*, 152*a* and 153*a*, respectively, which reflect the light dispersed from the light distribution member 140 to the corresponding first, second, and third light receiving parts 121, 122 and 123.

First, second, and third waste toner detecting regions 161, 162 and 163 are defined between the light distribution member 140 and the first, second, and third light guide members 151, 152 and 153, respectively. The first, second, and third waste toner detecting regions 161, 162 and 163 are located at different positions in a vertical direction. More specifically, the first, second, and third waste toner detecting regions 161, 162 and 163 are positioned at different heights. The first waste toner detecting region 161, which is defined between the light distribution member 140 and the first light guide member 151, is disposed at the lowermost position. The third waste toner detecting region 163, which is defined between the light distribution member 140 and the third light guide member 153, is disposed at the uppermost position. The second waste toner detecting region 162, which is defined between the light distribution member 140 and the second light guide member 152, is disposed between the first waste toner detecting region 161 and the third waste toner detecting region 163.

If the waste toner exists at the first, second, and third waste toner detecting regions 161, 162 and 163, the light emitted from the light emitting part 110 cannot pass through the waste toner detecting regions 161, 162 and 163, and thus cannot be transmitted to the first, second, and third light receiving parts 121, 122 and 123. In contrast, if the waste toner is not accumulated to the first, second, and third waste toner detecting regions 161, 162 and 163, the light emitted from the light emitting part 110 can pass through the first, second, and third waste toner detecting regions 161, 162 and 163, and thus the first, second, and third light receiving parts 121, 122 and 123 can each receive the light.

Hereinafter, the operation of detecting the amount of the waste toner stored in the waste toner container will be described with reference to FIGS. 3 and 4.

Figure 4A:
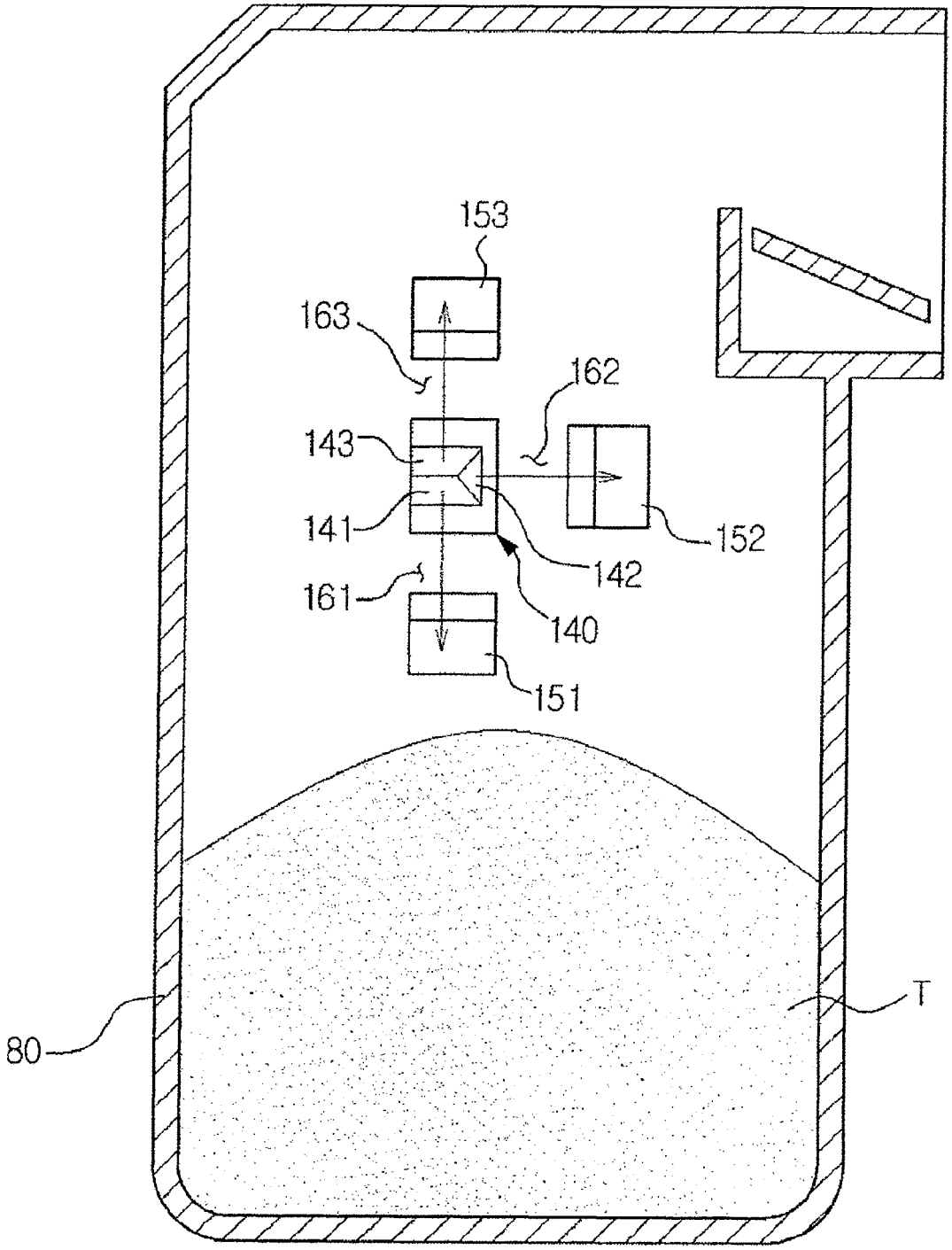
FIGS. 4A through 4D are sectional views illustrating an operation of detecting an amount of waste toner accumulated and stored in a waste toner container.

As illustrated in FIG. 4A, when a waste toner T is stored in the waste toner container 80 below the first waste toner detecting region 161, the waste toner T does not block the light passing through the first, second, and third waste toner detecting regions 161, 162 and 163. Accordingly, the light emitted from the light emitting part 110 is dispersed by the light distribution member 140, and transmitted to the first, second, and third light receiving parts 121, 122 and 123 via the first, second, and third waste toner detecting regions 161, 162 and 163 and the first, second, and third light guide members 151, 152 and 153. If the first, second, and third light receiving parts 121, 122 and 123 each receive the light, a control unit (not illustrated) of the image forming apparatus determines that the waste toner container 80 is not yet filled with the waste toner and does not send a signal to the display 1 to alert the user.

Figure 4B:
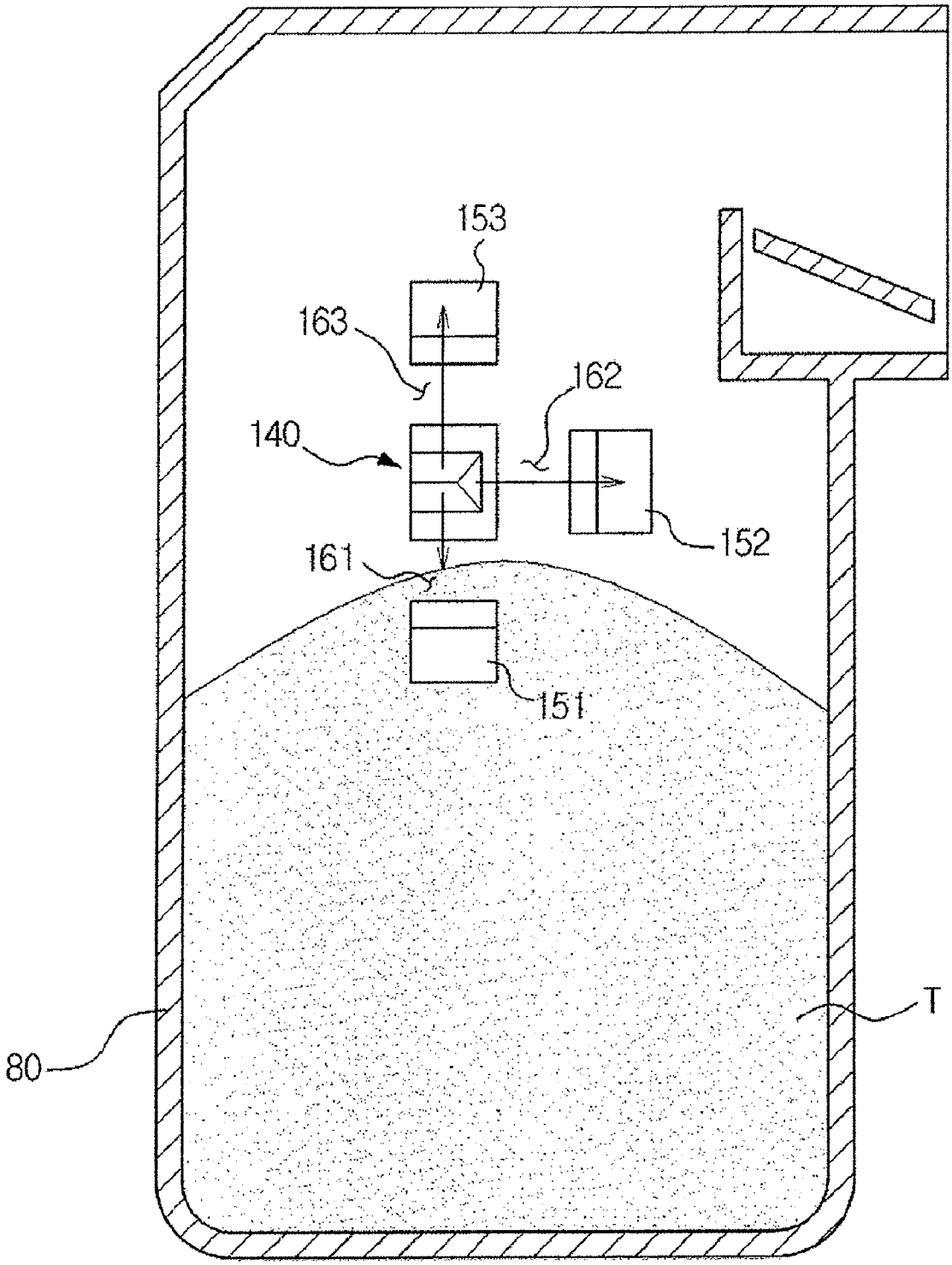

As illustrated in FIG. 4B, if the waste toner is further accumulated to a level of the first waste toner detecting region 161 as the printing operation is performed, the light distributed to the first waste toner detecting region 161 from the light distribution member 140 is blocked by the waste toner T, and thus cannot be transmitted to the first light receiving part 121. More specifically, the first light receiving part 121 cannot receive the light, and the second and third light receiving parts 122 and 123, respectively, receive the light. As such, if the second and third light receiving parts 122 and 123 each receive the light, the control unit determines that the waste toner T is accumulated in the waste toner container 80 by a predetermined amount (e.g., 80% of the storage capacity of the container 80), and sends a signal to the display 1 to the user of the amount of waste toner T that has accumulated.

Figure 4C:
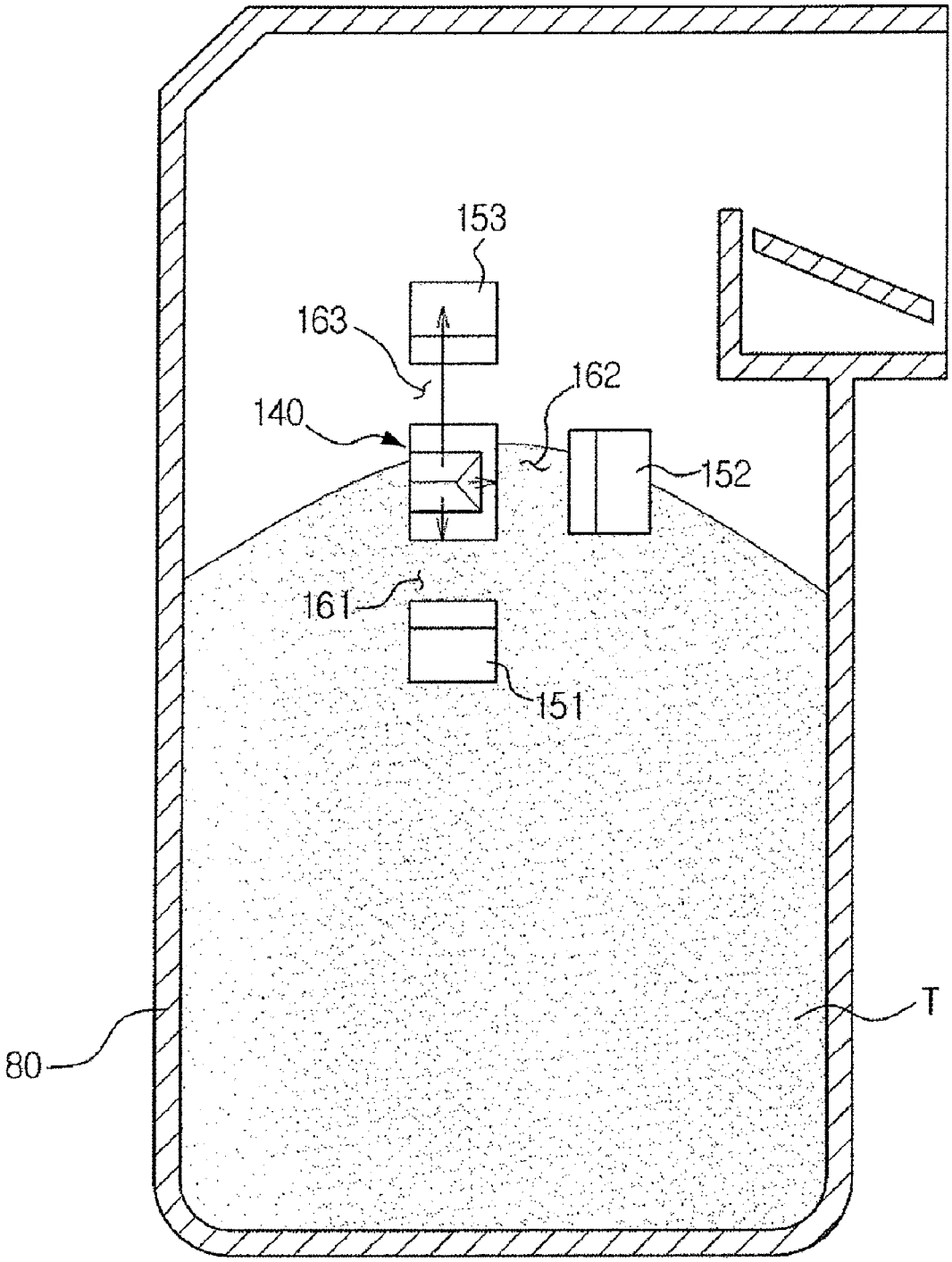

As illustrated in FIG. 4C, if the waste toner is further accumulated to a level of the second waste toner detecting region 162, the light emitted from the light emitting part 110 cannot pass through the first waste toner detecting region 161 and the second waste toner detecting region 162 because it is blocked by the waste toner T. Accordingly, the first and second light receiving parts 121 and 122 cannot receive the light, and the third light receiving part 123 receives the light. As such, if only the third light receiving part 123 receives the light, the control unit determines that the waste toner T is accumulated in the waste toner container 80 by a predetermined amount (e.g., 90% of the storage capacity of the container 80), and sends a signal to the display 1 to alert the user of the amount of waste toner T that has accumulated.

Figure 4D:
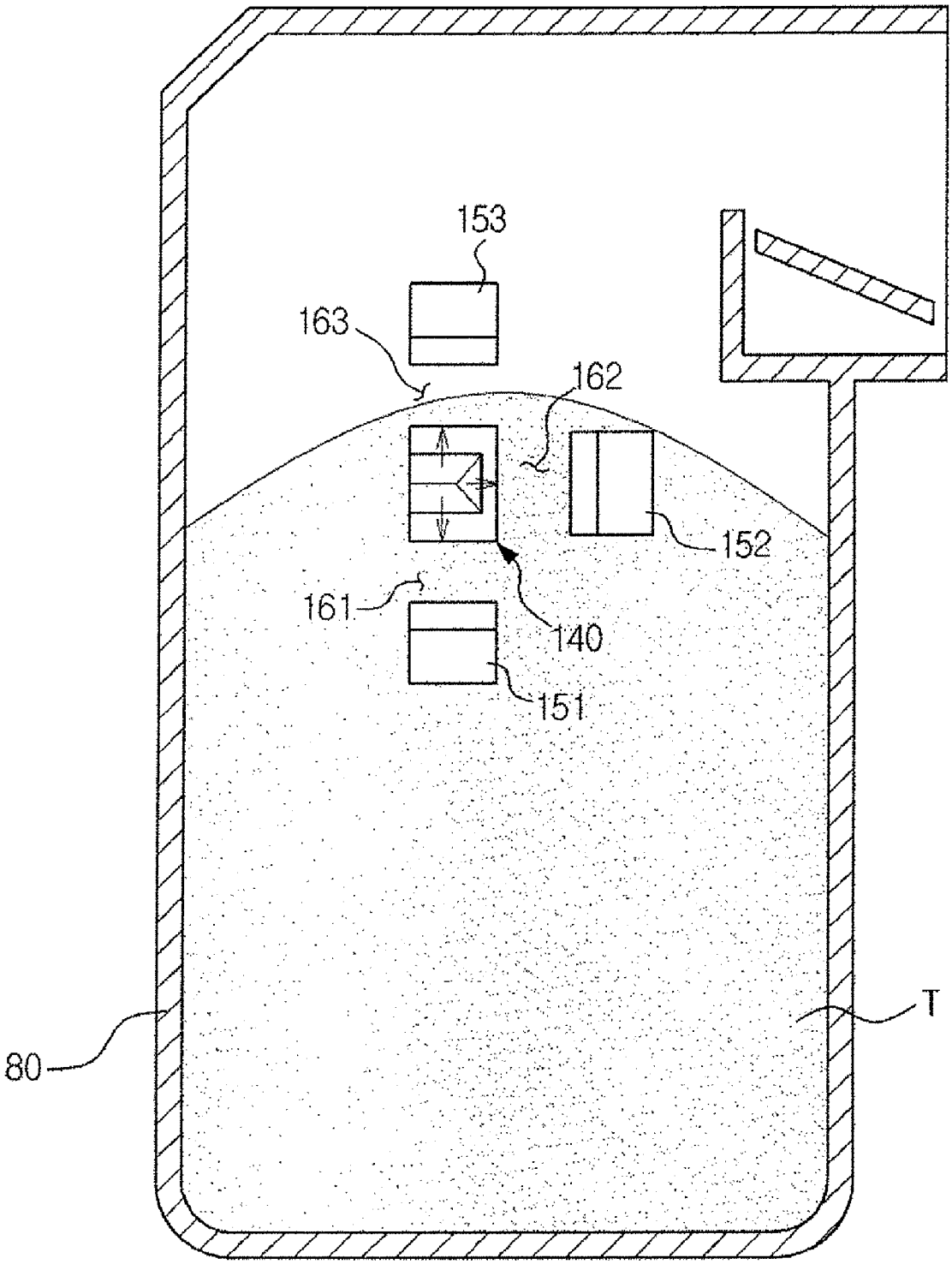

As illustrated in FIG. 4D, if the waste toner is further accumulated to a level of the third waste toner detecting region 163, the light emitted from the light emitting part 110 cannot pass through the first, second or third waste toner detecting regions 161, 162 and 163 because it is blocked by the waste toner T. Accordingly, the light cannot be transmitted to the first to third light receiving parts 121, 122 and 123. As such, if the first, second, and third light receiving parts 121, 122 and 123 do not receive the light, the control unit determines that the waste toner container 80 is filled with the waste toner T, and sends a signal to the display 1 to alert the user to replace the waste toner container 80.

The above operation can be summarized in a following table 1. In the table 1, the state that each of the respective first, second, and third light receiving parts 121, 122 and 123 receive the light is denoted by "ON," and the state that each of the respective first, second, and third light receiving parts 121, 122 and 123 do not receive the light is denoted by "OFF."

TABLE 1

| | accumulated amount of waste toner (%) | | | |
|---|---|---|---|---|
| | 0~79 | 80~89 | 90~99 | 100 |
| first light receiving part 121 | ON | OFF | OFF | OFF |
| second light receiving part 122 | ON | ON | OFF | OFF |
| third light receiving part 123 | ON | ON | ON | OFF |
| alarming message | — | accumulated amount of waste toner 80% | accumulated amount of waste toner 90%, prepare new waste toner container | accumulated amount of waste toner 100%, replace waste toner container |

The embodiment of FIGS. 2 through 4 of the present general inventive concept is capable of checking an accumulated amount of the waste toner in the waste toner container 80 in stages, however does not discriminate between a condition when the waste toner container 80 is not installed and a condition when the waste toner container 80 is filled with the waste toner as illustrated in FIG. 4D. This is because first, second, and third light receiving parts 121, 122 and 123 all do not receive the light in both situations.

Figure 5:
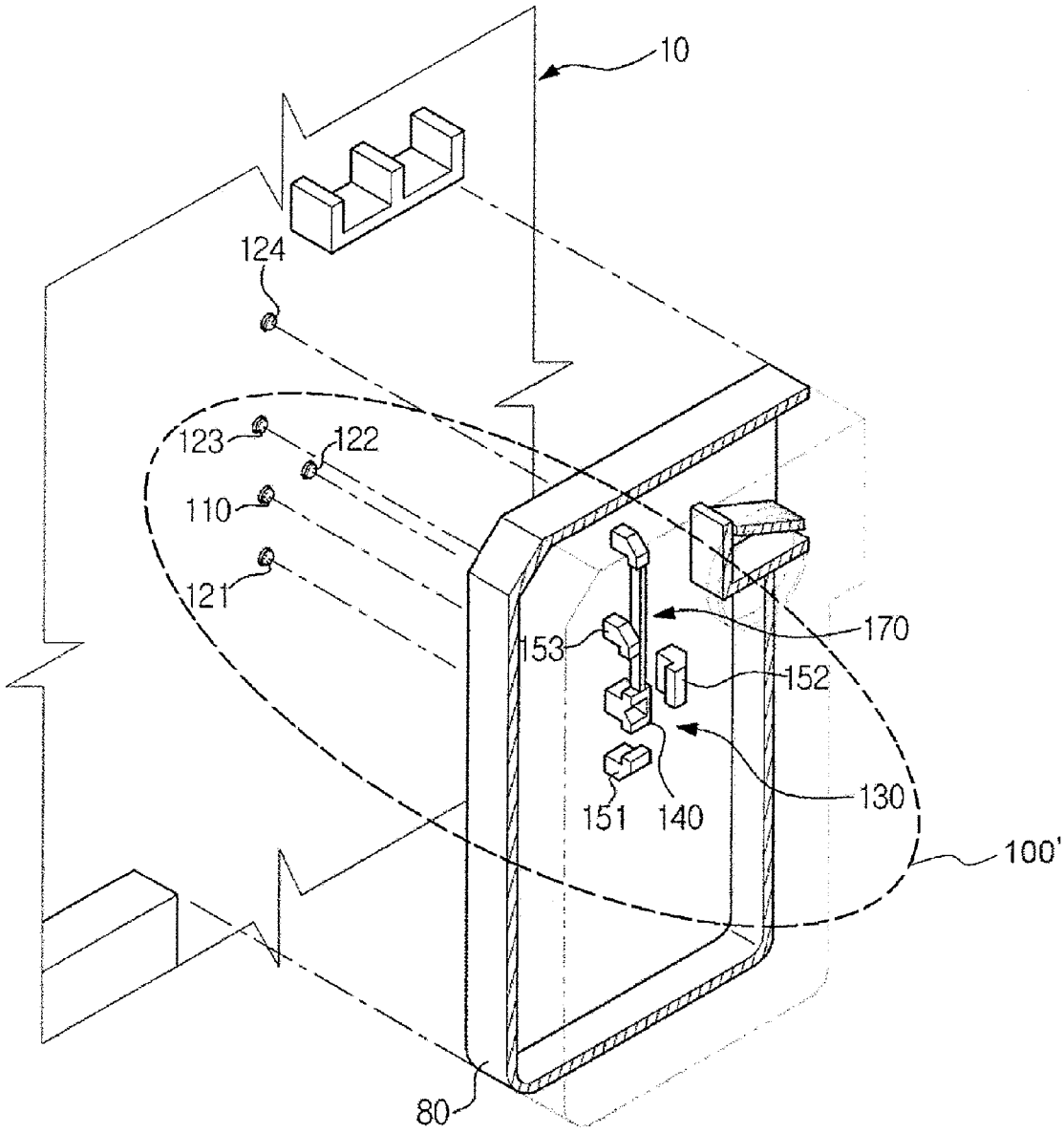
FIG. 5 is a perspective view illustrating modifications of a waste toner container and a waste toner detecting device of an image forming apparatus according to another embodiment of the present general inventive concept.
Figure 6:
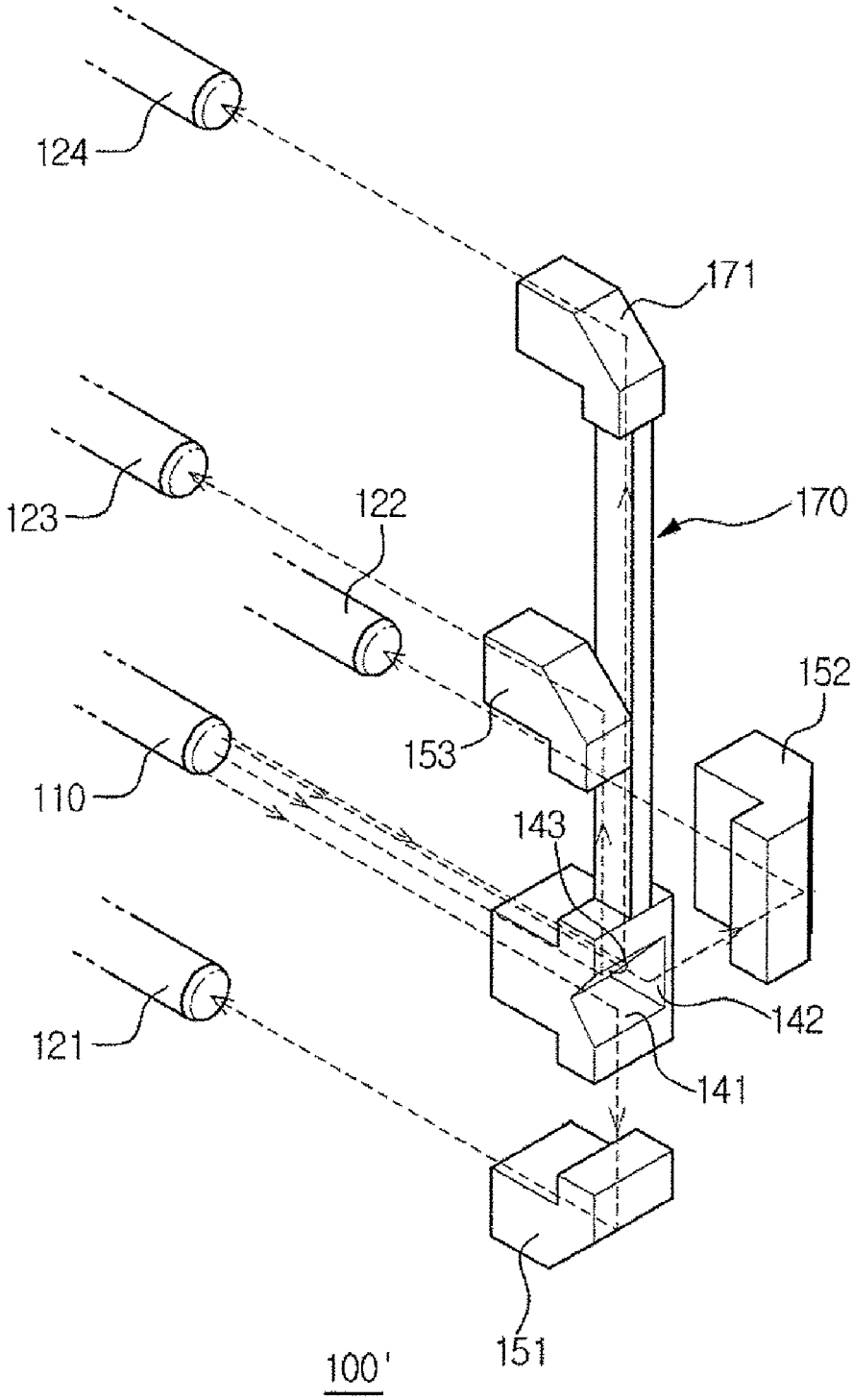
FIG. 6 is an enlarged perspective view illustrating the waste toner detecting device depicted in FIG. 5.
Figure 7:
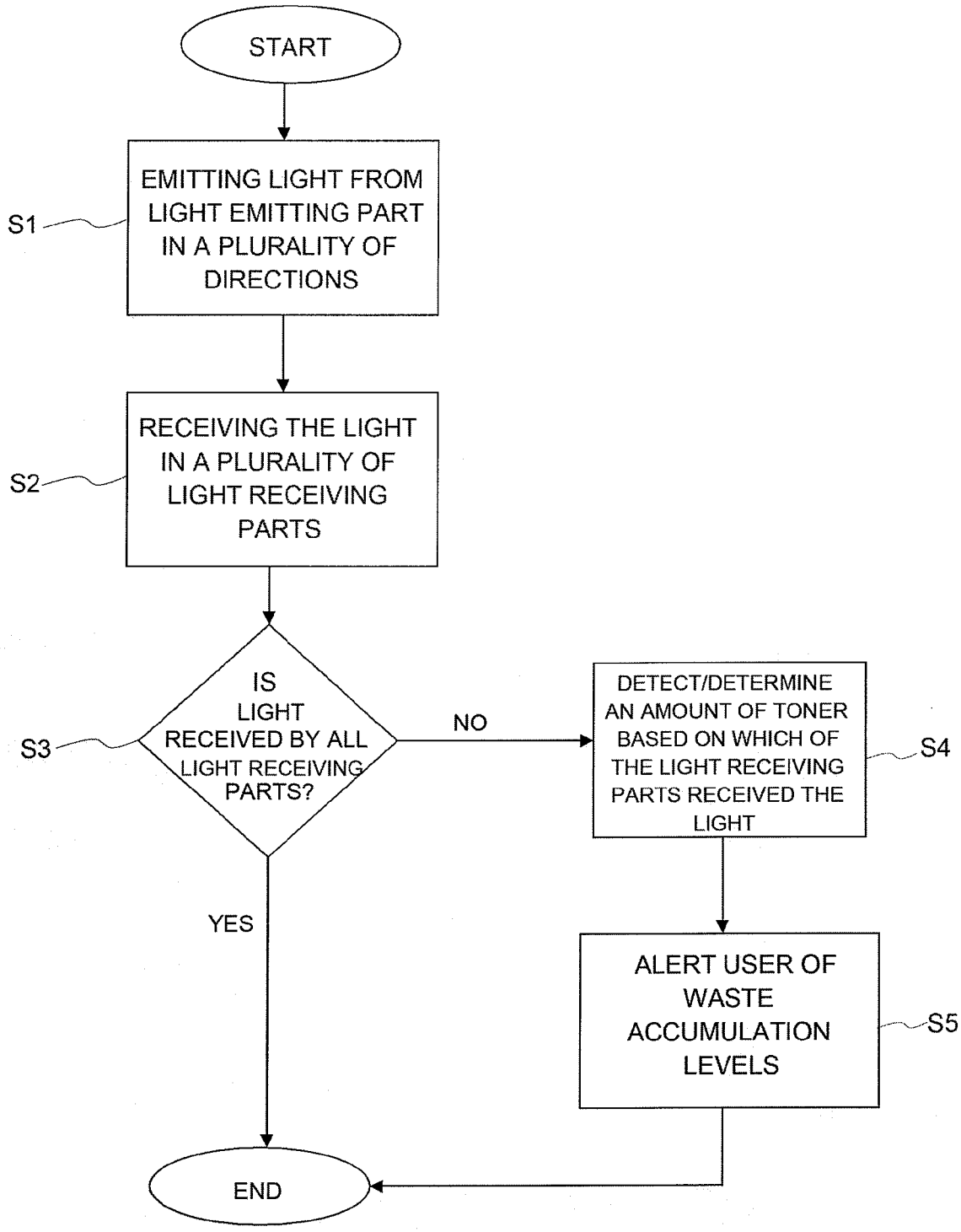
FIG. 7 is a flowchart illustrating a method of detecting an accumulation of waste toner in a waster toner container according to the present general inventive concept.

FIG. 5 is a perspective view illustrating modifications of the waste toner container and the waste toner detecting device according to another embodiment of the present general inventive concept, and FIG. 6 is an enlarged perspective view illustrating the waste toner detecting device depicted in FIG. 5. In the following description, the same elements as the previous embodiment illustrated in FIGS. 2 and 3 are denoted by the same reference numerals, and only the features of this embodiment will be explained.

As illustrated in FIGS. 5 and 6, a waste toner detecting device 100' according to another embodiment further includes a fourth light receiving part 124 to check whether the waste toner container 80 is installed. As long as the waste toner container 80 is installed, the fourth light receiving part 124 always receives the light regardless of the accumulated amount of the waste toner in the waste toner container 80.

To allow the light emitted from the light emitting part 110 to be transmitted to the fourth light receiving part 124 without being affected by the waste toner, the waste toner detecting device 100' includes a light guide part 130' having a light path member 170. The light path member 170 is made of a transparent material that light can permeate. The light path member 170 extends from the light distribution member 140 such that a first end is connected to the light distribution member 140 and a second end opposes the fourth light receiving part 124. Accordingly, the light path member 170 guides a portion of the light dispersed from the light distribution member 140 to the fourth light receiving part 124. The light path member 170 may include a reflecting portion 171 which reflects the light distributed from the light distribution member 140 to the fourth light receiving part 124.

Since the operation of detecting the accumulated amount of the waste toner of this embodiment is the same as that of the previous embodiment illustrated in FIG. 4, only a characteristic operation of this embodiment will be described hereinafter. As illustrated in FIGS. 5 and 6, if the waste toner container 80 is installed in the main body 10 of the image forming apparatus, the light emitted from the light emitting part 110 is reflected from the first, second, and third reflecting portions 141, 142 and 143 of the light distribution member 140 and progresses in different directions. Especially, a portion of the light reflected from the third reflecting portion 143 is directed toward the third light guide member 153, and another portion of the light progresses along the light path member 170 and is transmitted to the fourth light receiving part 124.

In contrast, if the waste toner container 80 is separated from the main body 10, the light emitted from the light emitting part 110 is not guided toward the fourth light receiving part 124, and thus the fourth light receiving part 124 cannot receive the light.

Accordingly, a determination of whether the waste toner container 80 is installed in the main body 10 depends on a determination of whether the fourth light receiving part 124 receives the light.

The above operation of the embodiment of FIGS. 5 and 6 can be summarized in the following table 2.

TABLE 2

| | accumulated amount of waste toner (%) | | | | |
|---|---|---|---|---|---|
| | 0~79 | 80~89 | 90~99 | 100 | no waste toner container |
| first light receiving part 121 | ON | OFF | OFF | OFF | OFF |
| second light receiving part 122 | ON | ON | OFF | OFF | OFF |
| third light receiving part 123 | ON | ON | ON | OFF | OFF |
| fourth light receiving part 124 | ON | ON | ON | ON | OFF |
| alarming message | — | accumulated amount of waste toner 80% | accumulated amount of waste toner 90%, prepare new waste toner container | accumulated amount of waste toner 100%, replace waste toner container | waste toner container is not installed |

A method of detecting an accumulation of a waste toner in the waste toner container 80 which is detachably installed in the main body 10 of an image forming apparatus will now be described in accordance with the various embodiments of the waste toner detecting devices 100 and 100'. In operation S1, light is emitted from the light emitting part 110, which is inside the waste toner container 100 or 100', in a plurality of directions. In operation S2, a plurality of light receiving parts 120 receive the light emitted from the light emitting part 110. If light is received by all the light receiving parts 120 in operation S3, then the method terminates. However, if light is not received by all the light receiving parts 120 in operation S3, the a determination is made about how much toner is in the waste toner container 80 based on a detection of which of the light receiving parts 120 received the light in operation S4. Finally, in operation S5, an alert is sent to a user regarding how much waste toner has been accumulated in the waste toner container 80.

As apparent from the above description, the image forming apparatus according to the present general inventive concept is equipped with a light distribution member to distribute a light emitted from a light emitting part, thereby enabling a user to check an amount of waste toner stored in a waste toner container in stages while minimizing a number of elements in the waste toner container.

Further, since the image forming apparatus according to various embodiments of the present general inventive concept is capable of also giving the user information regarding whether the waste toner container is installed or not by using a waste toner detecting device, convenience in use increases.

Although a few embodiments of the present general inventive concept have been shown and described, it would be appreciated by those skilled in the art that changes may be made in these embodiments without departing from the principles and spirit of the general inventive concept, the scope of which is defined in the claims and their equivalents.

What is claimed is:

1. An image forming apparatus, comprising:

a main body;

a waste toner container installed in the main body to store waste toner;

a light emitting part at a first side of the waste toner container to emit light to an interior of the waste toner container in an emitting direction;

a plurality of light receiving parts at the first side of the waste toner container to receive the light emitted from the light emitting part to detect an amount of the waste toner stored in the waste toner container; and a light distribution member at a second side of the waste toner container to distribute the light emitted in the emitting direction from the light emitting part to a plurality of light paths in a plurality of directions, respectively to the interior of the waste toner container, the plurality of light receiving parts corresponding respectively to the plurality of light paths to receive the light distributed to the plurality of light paths.

2. The image forming apparatus according to claim 1, wherein waste toner detecting regions are respectively defined on the light paths between the light distribution member and the plurality of light receiving parts.

3. The image forming apparatus according to claim 2, wherein the waste toner detecting regions are located at different positions along an accumulated direction of the waste toner in the waste toner container.

4. The image forming apparatus according to claim 1, wherein the light distribution member includes a plurality of reflecting portions to reflect the light emitted from the light emitting part in different directions.

5. The image forming apparatus according to claim 1, further comprising:

light guide members to guide the light distributed from the light distribution member to the light receiving parts respectively corresponding to the light guide members.

6. The image forming apparatus according to claim 5, wherein each of the light guide members includes a reflecting portion to reflect the light transmitted from the light distribution member to the light receiving parts.

7. The image forming apparatus according to claim 5, wherein the light emitting part and the light receiving parts are mounted on the main body, and the light distribution member and the light guide members are mounted on the waste toner container.

8. The image forming apparatus according to claim 7, wherein at least one of the light distribution member and the light guide members is formed integrally with the waste toner container.

9. The image forming apparatus according to claim 5, wherein the light distribution member and the light guide members are made of a transparent material that light can permeate.

10. The image forming apparatus according to claim 1, further comprising:

a light path member to extend from the light distribution member, the light path member having a first end connected to the light distribution member and a second end corresponding to one of the plurality of light receiving parts.

11. An image forming apparatus including a waste toner detecting device to detect an amount of waste toner stored in a waste toner container, wherein the waste toner detecting device comprises:

a light emitting part at a first side of the waste toner container to emit light to an interior portion of the waste toner container in an emitting direction;

a light distribution member at a second side of the waste toner container to disperse the light emitted in the emitting direction from the light emitting part to a plurality of light paths corresponding respectively to a plurality of directions to the interior portion of the waste toner container;

a plurality of light receiving parts at the first side of the waste toner container to receive the light distributed from the light distribution member; and a waste toner detecting portion including a plurality of waste toner detecting regions respectively defined on the plurality of light paths of the light progressing in the plurality of directions from the light distribution member.

12. The image forming apparatus according to claim 11, wherein the light distribution member includes a plurality of reflecting portions which reflect the light emitted from the light emitting part in different directions.

13. The image forming apparatus according to claim 11, wherein the waste toner detecting device further includes at least one light guide member provided on paths of the light progressing in different directions from the light distribution member to guide the light to the light receiving parts respectively corresponding to the at least one light guide member.

14. The image forming apparatus according to claim 11, wherein the plurality of light receiving parts include a light receiving part to receive the light regardless of the amount of the waste toner stored in the waste toner container.

15. The image forming apparatus of claim 11, further comprising:

a display to alert a user when the waste toner container has reached various accumulation capacities based on the detection of the light emitted from the light emitting part.

16. A waste toner detecting device of an image forming apparatus, the waste toner detecting device comprising:

a light emitting part to emit light in an emitting direction in an interior portion of a waste toner container;

a light distribution member to receive the emitted light on the emitted light path and to distribute the emitted light to a plurality of light paths in a plurality of directions, respectively, the plurality of directions being opposite from the emitting direction; and a plurality of waste toner detecting regions distributed inside the interior portion of the waste toner container and corresponding respectively to the plurality of light paths to detect the light distributed in the plurality of directions of the respective light paths and to determine an amount of waste toner accumulated in the waste toner container based on the detected light, the plurality of waste toner detecting regions comprising a plurality of light receiving parts corresponding respectively to the plurality of light paths to respectively receive the light distributed in the plurality of directions.

17. The waste toner detecting device of claim 16, wherein the plurality of waste toner detecting regions comprise:

a plurality of light guide parts to guide the light distributed from the light distribution member to the plurality of light receiving parts.

18. The waste toner detecting device of claim 17, further comprising:

a light path member to guide the distributed light to one of the plurality of light receiving parts regardless of the amount of accumulated waste toner.

19. The waste toner detecting device of claim 17, wherein at least one of the plurality of light receiving parts detects whether the waste toner container is installed in the image forming apparatus.

20. The waste toner detecting device of claim 16, wherein the light distribution member directs the distributed light toward the plurality of waste toner detecting regions.

21. A method of detecting an accumulation of a waste toner in a waste toner container detachably installed in an image forming apparatus, the method comprising:

emitting light from a light emitting part inside the waste toner container in an emitting direction;

receiving the emitted light and distributing the emitted light to a plurality of light paths in a plurality of directions, respectively, the plurality of directions being opposite from the emitting direction;

receiving the light distributed to the plurality of light paths using a plurality of light receiving parts corresponding respectively to the plurality of light paths in the plurality of directions;

detecting an amount of the waste toner accumulated in the waste toner container based on which of the plurality of light receiving parts receives the light; and alerting a user of various waste toner accumulation levels based on the detected amount of waste toner.

22. The method of claim 21, further comprising:

detecting whether the wasted toner container is attached to the image forming apparatus based on whether one of the plurality of light receiving parts receives the light.

23. An image forming apparatus, comprising:

a main body;

a waste toner container installed in the main body to store waste toner;

a light emitting part to emit light to the waste toner container in an emitting direction;

a light distribution member to distribute the light emitted in the emitting direction from the light emitting part to a plurality of light paths in a plurality of directions, respectively;

a plurality of light receiving parts to receive the light emitted from the light emitting part to detect an amount of the waste toner stored in the waste toner container, the plurality of light receiving parts corresponding respectively to the plurality of light paths to receive the light distributed to the plurality of light paths;

light guide members to guide the light distributed from the light distribution member to the light receiving parts respectively corresponding to the light guide members; and waste toner detecting regions respectively defined on the light paths between the light distribution member and the light guide members.

* * * * *